US006378570B1

(12) United States Patent
Shipachev et al.

(10) Patent No.: US 6,378,570 B1
(45) Date of Patent: Apr. 30, 2002

(54) GAS CYLINDER AND A METHOD FOR FILLING THE SAME

(76) Inventors: Aleksei Borisovich Shipachev, 154 Krasnokokshaiskaya St. #56, Kazan (RU), 420102; Aleksei Lvovich Petrosyan, 4-1 Garibaldi St. #9, Moscow (RU), 117313; Sergei Anatolyevich Bagnyukov, 16A 50-letia Oktyabrya Prosp. #94, Klimovsk (RU), 142080

( * ) Notice: Subject to any disclaimer, the term of this patent is extended or adjusted under 35 U.S.C. 154(b) by 0 days.

(21) Appl. No.: 09/719,541

(22) PCT Filed: Apr. 27, 2000

(86) PCT No.: PCT/RU00/00157

§ 371 Date: Feb. 16, 2001

§ 102(e) Date: Feb. 16, 2001

(87) PCT Pub. No.: WO00/70263

PCT Pub. Date: Nov. 23, 2000

(30) Foreign Application Priority Data

May 13, 1999 (RU) ..... 99109668

(51) Int. Cl.[7] ..... B65B 1/04

(52) U.S. Cl. ..... 141/3; 141/20; 220/581; 53/79

(58) Field of Search ..... 220/581, 582, 220/584; 141/3, 19, 20, 46, 301; 53/79, 88, 89, 90, 97, 101, 108

(56) References Cited

U.S. PATENT DOCUMENTS

| | | | | |
|---|---|---|---|---|
| 2,425,448 A | | 8/1947 | Weida |
| 2,630,936 A | | 3/1953 | Freygang |
| 2,685,383 A | | 8/1954 | Kochner |
| 2,688,428 A | * | 9/1954 | Manhartsberger |
| 3,078,685 A | | 2/1963 | Flournoy |
| 4,832,224 A | | 5/1989 | Ozaki |
| 5,413,230 A | * | 5/1995 | Folter et al. |
| 5,713,342 A | * | 2/1998 | Simson |

FOREIGN PATENT DOCUMENTS

| | | |
|---|---|---|
| EP | 0 258 057 | 3/1988 |
| EP | 0 412 773 | 2/1991 |
| GB | 2 045 353 | 10/1980 |
| GB | 2 069 679 | 8/1981 |
| RU | 825107 | 4/1981 |
| RU | 2037736 | 7/1990 |

* cited by examiner

*Primary Examiner*—Steven O. Douglas
(74) *Attorney, Agent, or Firm*—Jacobson Holman, PLLC

(57) ABSTRACT

A gas cartridge comprises a body 1 with a neck 2. A movable valve made as a ball 3 is disposed inside the body 1. A cap 4 is installed in the neck. The end of the cap 4 can be chamfered or expanded. The ball 3 can be manufactured from an elastic, resilient material, from an elastic, resilient material with a metallic powdered filler or be fully metallic in an elastic, resilient envelope. A method of charging the gas cartridge comprises placing a movable valve inside the body of the cartridge, turning the cartridge with its neck downward and charging the cartridge with a liquefied gas under a pressure, reducing the charging pressure with simultaneous closing of the neck by the movable valve, closing the neck with a cap, pressing-in the cap and welding the flange of the cap to the face of the neck of the cartridge.

9 Claims, 3 Drawing Sheets

GAS CYLINDER AND A METHOD FOR FILLING THE SAME

FIELD OF THE ART

The present invention relates to the manufacture and charging with gas of gas cartridges, used, for example, for carbonizing water in siphons, for shooting from air weapons, for gas weapons, for inflating bicycle tyres.

STATE OF THE ART

Known in the art are technical solutions relevant to the structure of gas cartridges to be filled with a gas, for instance, with carbon dioxide gas $CO_2$, such cartridges being provided with a cover which tightly closes the neck of the cartridge to preclude gas leakage.

As the cover, use is made of: a cap (U.S. Pat. No. 2,425,448, Cl. 220–3, 1947) placed onto the neck of the gas bulb and welded to the face portion thereof; a closure (U.S. Pat. No. 2,630,936, Cl. 220–3, 1953) with a cylindrical tubular skirt which is disposed inside the neck portion of the gas container, said closure having a horizontal annular flange welded to the face portion of the neck; a sealing plate (UK Patent Application GB No. 2,045,353, Cl. F16K 17/16, 1980) in the middle, in the upside and underside of which oppositely located recesses are provided, that facilitate piercing of the plate, a fold welded to the face portion of the neck of the gas cartridge consisting of one or two folding portions; two sealing plates (EP Patent No. 0,412,773, Cl. F17C 13/06, 1994), the first of said plates being expanded inside the neck of the gas cartridge and the second of said plates being welded from above to the neck; a sealing plate (U.S. Pat. No. 4,832,224, Cl. 220–89, 1989) with a regulator for quantity of flowing gas, when the pressure inside the gas cartridge sharply increases; a dome-shaped membrane (EP Patent No. 0,258,057, Cl. F17C 13/06, 1988) whose flange shoulders are expanded in the neck of the gas cartridge.

The prior art most relevant to the gas cartridge of the present invention is the structure of a pressure bulb disclosed in U.S. Pat. No. 2,685,383, Cl. 220–3, 1954, said pressure bulb having a body with a neck wherein the body of a cap is disposed, flanges of the cap being welded to the face of the neck.

The prior art most relevant to the method of charging the gas cartridge according to the present invention is the method disclosed in U.S. Pat. No. 2,685,383, Cl. 220–3, 1954,said method comprising introducing carbon dioxide gas in the form of "dry ice" into the body of the pressure bulb, closing the bulb neck with a cap, pressing-in the cap, and welding the flange of said cap to the face of the neck.

All the above-cited devices and the method of charging suffer from the following common disadvantages. When charging is effected, e.g., with $CO_2$, "dry ice", i.e., solid carbon dioxide is always used. "Dry ice" is produced from liquid carbon dioxide. Losses for converting carbon dioxide from the liquid to the solid state amount to about 30%. The operations of charging the gas cartridge or bulb, plugging the cartridge with a cap and welding the cap to the neck of the cartridge must be carried out in succession with a minimum interval of time therebetween for reducing gas leakage. The provision of such a technological process requires developing of complicated and costly equipment.

ESSENCE OF THE INVENTION

The idea central to the proposed technical solution is to provide a gas cartridge fitted with a structurally simple, easy to manufacture, convenient in service movable valve in the form of a spherical ball. Due to this feature the gas cartridge can be filled directly with $CO_2$ in its liquid state, whereby the operation of preliminary $CO_2$ conversion from the liquid state to the solid state of "dry ice" is obviated, i.e. losses of carbon dioxide when filling the cartridge are reduced by at least 30%. The use of such a movable valve makes it possible to divide the process of manufacturing a filled gas cartridge into two independent technological operations spaced in time:

filling the cartridge with liquefied gas with the possibility of long-term storage thereof;

plugging the cartridge with a cap and welding the cap to the cartridge.

Thereby it becomes possible to simplify the requirements to the process equipment and, as a consequence, to cut down the manufacturing cost of gas cartridges.

This is accomplished due to the fact that the gas cartridge consisting of a body with a neck is provided with a cap which is inserted into the neck of the cartridge. Flanges of the cap are welded to the face of the cartridge neck, and the cap is provided with a membrane having a recess. Inside the body of the gas cartridge, prior to charging thereof with liquefied gas, a movable valve is arranged, this valve being a spherical ball whose diameter is larger than the diameter of the orifice in the neck. The length of the portion of the cap located in the neck is such that after installing the cap the ball cannot close the neck orifice completely.

In order that, after the membrane has been pierced, the ball could not shut off the ingress of gas from the gas cartridge into the cap, the end of the cap located in the neck is made with a chamfer or expanded, e.g., made "star"-shaped.

The ratio of the averaged specific density of the materials from which the ball is manufactured and of the ball diameter is selected such that after charging the gas cartridges before closing the cartridge with the cap, the ball, under the effect of the gas pressure which is approximately 60 times the ambient pressure, could not jump out through the neck.

The ball can be manufactured from an elastic, resilient material; from an elastic, resilient material with a metallic powdered filler; be made fully metallic and enclosed in an elastic, resilient envelope.

In the proposed method of charging the gas cartridge, prior to charging it, a movable valve is placed into the body of the cartridge, then the cartridge is turned with its neck downward, and is charged with liquefied gas under a pressure, then the charging pressure is reduced, and the movable valve under the effect of the pressure inside the cartridge closes the orifice in the neck, so that the cartridge can be stored for a long time without the gas leakage therefrom; after that the neck is closed with the cap, the cap is pressed-in, and the flange of the cap is welded to the face of the neck.

PREFERRED EMBODIMENT

Figure 1:
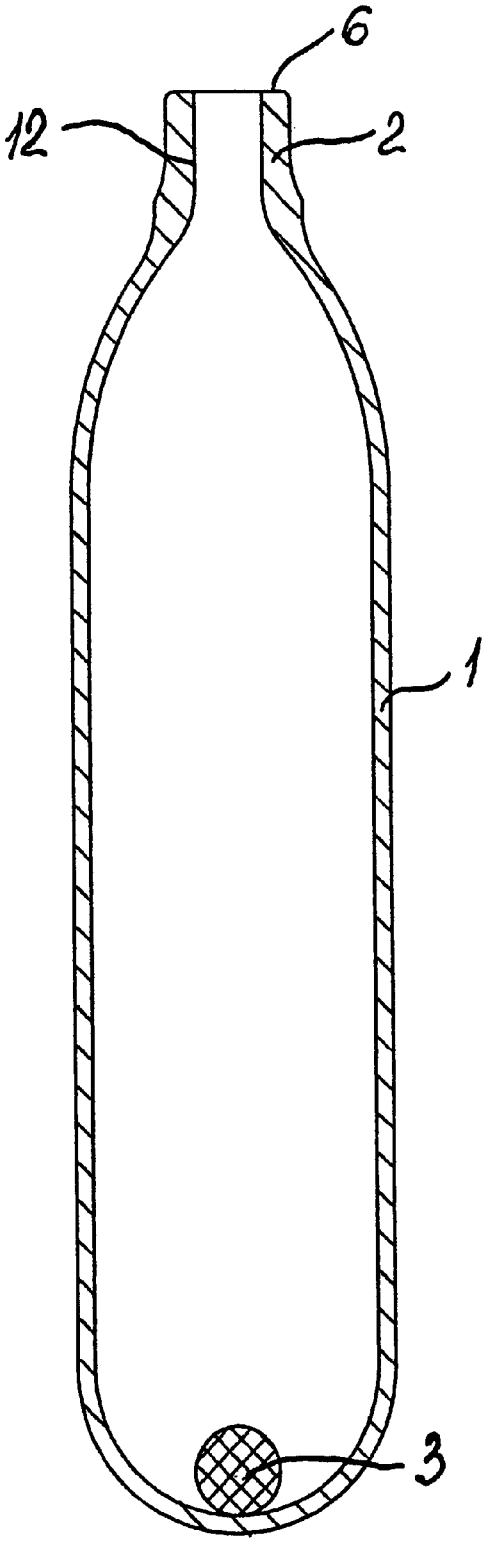
FIG. 1 shows a gas cartridge with a ball disposed in the body of the cartridge prior to charging the cartridge with gas.
Figure 3:
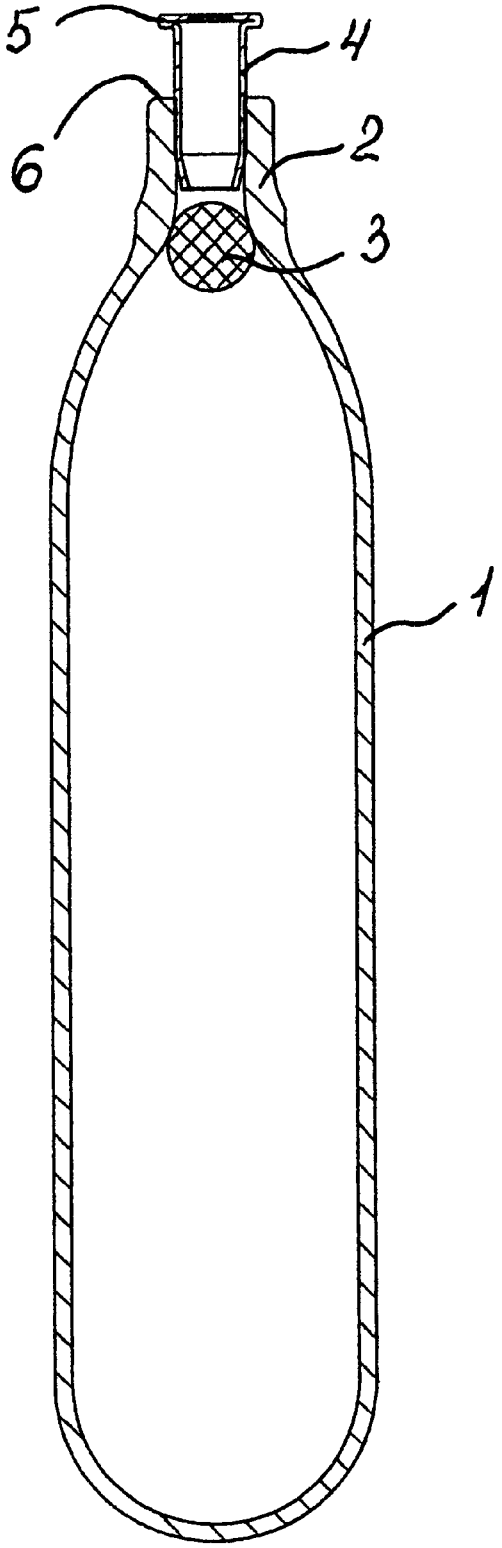
FIG. 3 shows a gas cartridge charged with gas, when the movable ball has shut off the orifice in the neck, preventing gas leakage from the cartridge, with a cap installed in the neck of the cartridge.
Figure 5:
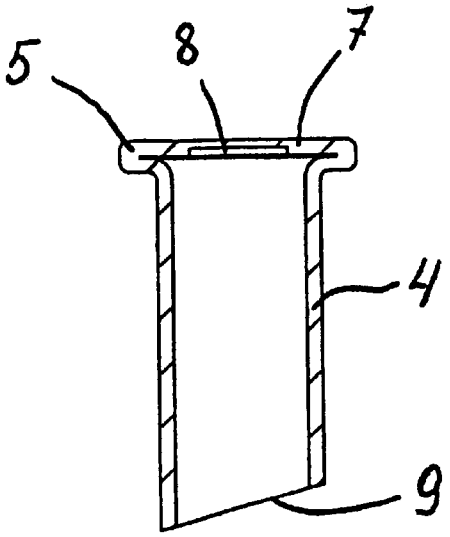
FIG. 5 is a side view of the cap with a chamfer.
Figure 6:
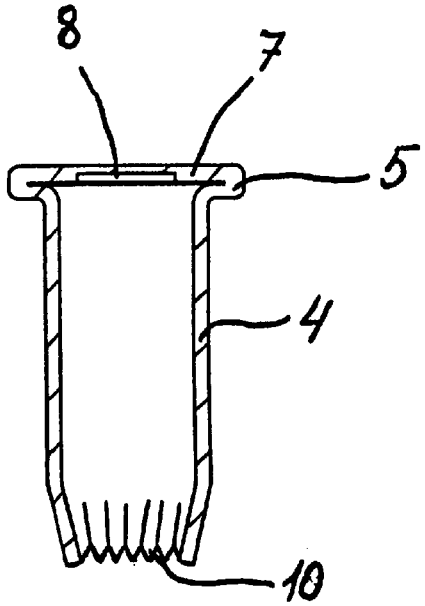
FIG. 6 is a side view of the cap with an expanded lower portion.
Figure 7:
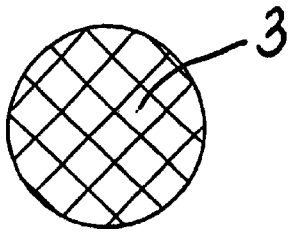
FIG. 7 is a cross-sectional view of a ball made from an elastic, resilient material.
Figure 8:
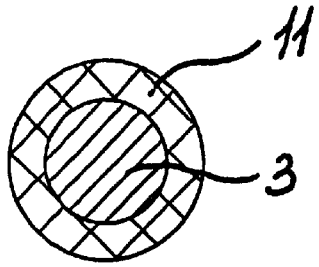
FIG. 8 is a crcss-sectional view of an all-metal ball in an elastic, resilient envelope.

A gas cartridge comprises a body 1 with a neck 2. A ball 3 is disposed inside the Body 1 (FIG. 1). In the neck 2 a cap 4 is located, whose flange 5 is welded to the face 6 of the neck 2 (FIG. 3). In a membrane 7 of the cap 4 a recess 8 is provided to facilitate piercing of the membrane 7. One end of the cap has a chamfer 9 (FIG. 5) or is expanded, e.g., to make a "star" 10 (FIG. 6). The ball 3 can be manufactured from an elastic, resilient material (FIG. 7), from an elastic, resilient material with a metallic powdered filler, or be fully metallic and enclosed in an elastic, resilient envelope 11 (FIG. 8) for snugly fitting against the walls of orifice 12 in the neck 2.

Charging the gas cartridge is carried out in the following manner.

Figure 2:
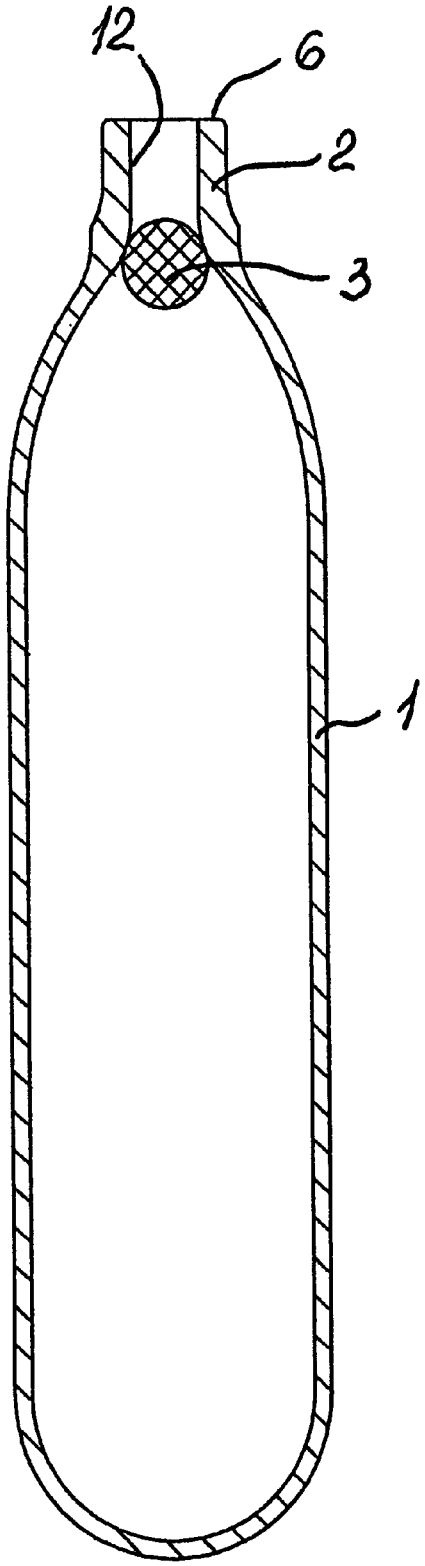
FIG. 2 shows a gas cartridge charged with gas, when the movable ball has shut off the orifice in the neck, preventing gas leakage from the cartridge.
Figure 4:
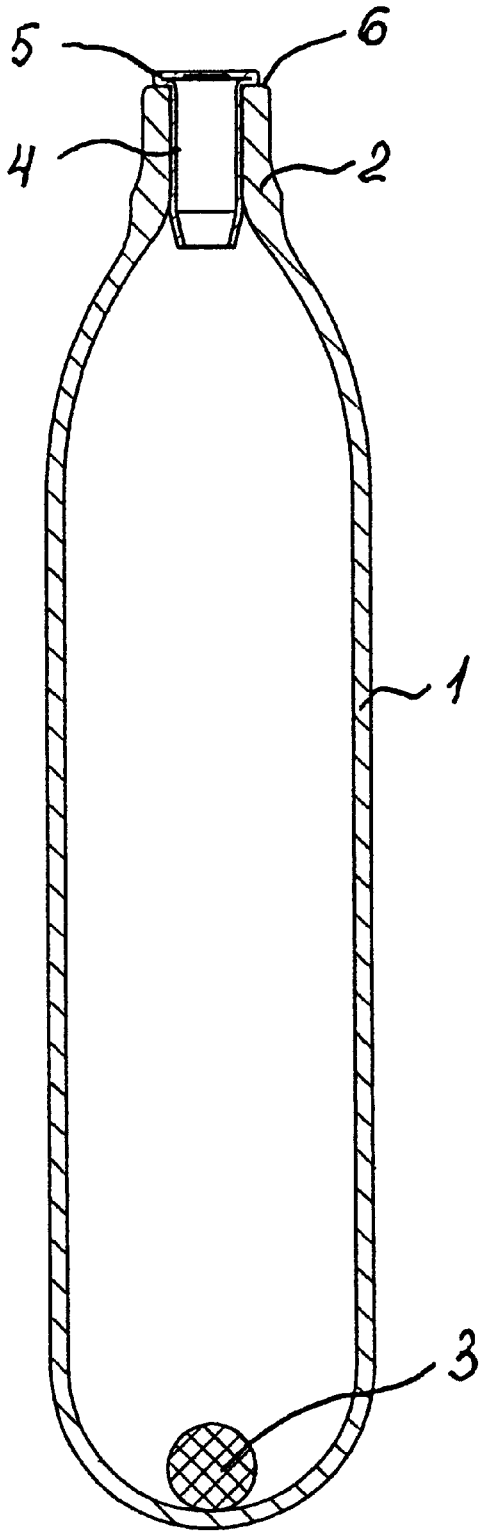
FIG. 4 shows a gas cartridge filled with gas, after the cartridge has been closed with a cap and the flange of the cap has been welded to the face of the neck of the cartridge.

The gas cartridge with the ball 3 disposed preliminarily in the body 1 (FIG. 1) is turned with the neck 2 downward and filled with liquefied gas under a pressure exceeding 10000 gPa through the neck 2. Under the effect of the gas pressure in the cartridge, the ball 3 descends and fully and tightly shuts off the orifice 12 in the neck 2, precluding gas leakage from the cartridge. After that the cartridge is returned to its normal position (FIG. 2). The gas cartridge can be stored in such a state for a long time. The leakage of gas from the cartridge is practically ruled out. Then the cartridge is closed with a cap 4 (FIG. 3), and as a result of this operation the ball 3 is pushed by the end of the cap 4 from the orifice 12 in the neck 2. The cap 4 is then pressed-in and its flange 5 is welded to the face 6 of the neck 2. The ball 3 descends to the bottom of the gas cartridge, because the specific density of the ball 3 is greater than the specific density of the gas, and the pressure inside the gas cartridge after welding the cap 4 to the neck 2 is constant (FIG. 4).

INDUSTRIAL APPLICABILITY

The present invention can be easily manufactured from contemporary materials on the basis of the present-day technology and may be effectively used for carbonizing water in siphons, for shooting from air weapons, for inflating cycle tyres.

What is claimed is:

1. A gas cartridge comprising a body with a neck having an orifice into which a cap is inserted, whose flange is welded to the face ox the neck, and whose membrane is provided with a recess characterized in that inside the body, prior to charging the cartridge with liquefied gas, a movable ball is disposed, whose diameter is larger than the diameter of the orifice in the neck, and the length of the cap is such that after the cap has been installed the bell cannot fully close the orifice in the neck.

2. A gas cartridge of claim 1, characterized in that the end of the cap disposed in the neck is expanded so that after the membrane of the cap has been pierced, the ball cannot shut off the ingress of the gas inside the cap.

3. A gas cartridge of claim 1, characterized in that the end of the cap disposed in the neck is chamfered so that after the membrane of the cap has been pierced, the ball cannot shut off the ingress of the gas inside the cap.

4. A gas cartridge of claim 1, characterized in that the ratio of the averaged density of materials from which the ball is manufactured and the ball diameter is such that, after the cartridge has been filled, with liquefied gas, the ball under the effect of the gas pressure sticks in the neck and completely precludes gas leakage from the cartridge.

5. A gas cartridge of claim 4, characterized in that the ball is manufactured from an elastic, resilient material.

6.A gas cartridge of claim 4, characterized in that the ball is manufactured from an elastic, resilient material with a metallic powdered filler.

7. A gas cartridge of claim 4, characterized in that the ball is fully metallic, in an elastic, resilient envelope.

8. A method of filling gas cartridge, comprising the steps of closing the neck of the gas cartridge with a cap, pressing-in the cap and welding the flange of the cap to the face of the neck characterized in that prior to charging the cartridge, a movable valve is disposed inside the body of the cartridge the cartridge is turned with the neck downward and charged with a liquefied gas under a pressure, then the pressure is reduced, the neck orifice being simultaneously closed by the movable valve under the gas pressure inside the cartridge, with a possibility of long-term storage of the charged cartridge before closing thereof with a cap.

9. A method of filling a gas cartridge of claim 8, characterized in that inside the body of the cartridge as a movable valve a ball is disposed.

* * * * *